United States Patent [19]

Kasai

[11] Patent Number: 4,513,483

[45] Date of Patent: Apr. 30, 1985

[54] SLIDE FASTENER STRINGER

[75] Inventor: Kazumi Kasai, Namerikawa, Japan

[73] Assignee: Yoshida Kogyo K. K., Tokyo, Japan

[21] Appl. No.: 560,116

[22] Filed: Dec. 12, 1983

[30] Foreign Application Priority Data

Dec. 13, 1982 [JP] Japan ..... 57-188379[U]

[51] Int. Cl.[3] ..... A44F 19/04

[52] U.S. Cl. ..... 24/409; 24/410; 24/411

[58] Field of Search ..... 24/403, 406, 408, 409, 24/410, 411, 412, 413, 414

[56] References Cited

U.S. PATENT DOCUMENTS 2,862,272 12/1958 Morin ..... 24/410

3,055,069 9/1962 Morin ..... 24/410

4,349,943 9/1982 Moertel ..... 24/410

*Primary Examiner*—Francis K. Zugel

*Assistant Examiner*—Peter A. Aschenbrenner

*Attorney, Agent, or Firm*—Hill, Van Santen, Steadman & Simpson

[57] ABSTRACT

A coupling element of a slide fastener stringer has a pair of integral upper and lower coupling portions having different shapes and engagable with the lower and upper coupling portions of adjacent coupling elements on a co-operating like stringer. The upper coupling portion has a side surface including a flat abutment surface extending perpendicularly to a stringer tape across the thickness of a longitudinal edge portion of the stringer tape. When lateral pulling forces are applied to the coupled stringers, areas on the abutment surfaces of the interdigitating coupling elements take up such forces and prevent the stringers from separation.

7 Claims, 9 Drawing Figures

SLIDE FASTENER STRINGER

BACKGROUND OF THE INVENTION

1. Field of the Invention

The present invention relates generally to a slide fastener, and more particularly to a slide fastener stringer comprising coupling elements each having a coupling portion composed of a pair of integral superposed head and support portions.

2. Prior Art

As shown in FIGS. 1 and 2, a known slide fastener comprises a pair of stringers each having a row of discrete molded coupling elements E mounted on and along a longitudinal edge of a stringer tape T. Each coupling element E has a coupling end portion projecting beyond the tape's longitudinal edge and composed of a pair of superposed head and support portions H, S disposed one on each side of the general plane P of the stringer tape T. The coupling element E is formed from a thermoplastic synthetic resin material such as nylon-66 by molding directly around the longitudinal edge of the tape T sandwiched between a pair of mold halves (not shown), so that the head and support portions H, S are separated by a mold parting line extending in the plane P of the tape T. Side surfaces A of the head and support portions H, S are bevelled at a suitable small angle to a normal to the tape T to allow the coupling element E to be easily removed from mold cavities in the mold halves during manufacture. The support portion S has recessed wings W disposed on opposide side of the head portion H, the wings W defining jointly with the head portions of a pair of adjacent coupling elements a pair of clearances or gaps G to allow the opposed rows of the coupling elements E to be smoothly coupled together.

When lateral pulling forces F are applied to the coupled stringers as shown in FIG. 1, the interdigitating head portions H are brought into abutting engagement together at the lower edge B of confronting bevelled side surfaces A, A thereof. The molded coupling elements are likely to be deformed at such load-bearing edges of the coupling end portions due to stresses concentrated therein. The coupled stringers having such deformed coupling elements are susceptible to accidental separation under severe lateral pulling forces applied thereto or a severe thrust applied perpendicularly to the plane P of the tape T. Since the gaps G extend near the general plane P of the tapes T, i.e. a plane of action of the lateral pulling forces F, the interdigitating coupling elements E, E are liable to be displaced away from each other in a direction perpendicular to the tape, as shown in FIG. 3.

SUMMARY OF THE INVENTION

According to the invention, a slide fastener stringer comprises a coupling element including a pair of integral upper and lower coupling portions having differenct shapes and engageable with the lower and upper coupling portions of adjacent coupling elements on a co-operating like stringer. The upper coupling portion extends from one side of a stringer tape toward the opposite side beyond the thickness of a longitudinal edge portion of the stringer tape. The upper coupling portion has a side surface including a flat abutment surface disposed adjacent to said lower coupling portion and extending perpendicularly to a stringer tape. When lateral pulling forces are applied to the coupled stringers, the abutment surfaces of the interdigitating coupling elements take up such forces and prevent the stringers from separation.

It is an object of the present invention to provide a slide fastener stringer which ensures secure coupling engagement with a co-operating like stringer against accidental separation even when subjected to severe lateral pulling forces or a severe vertical thrust.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

Figure 4:
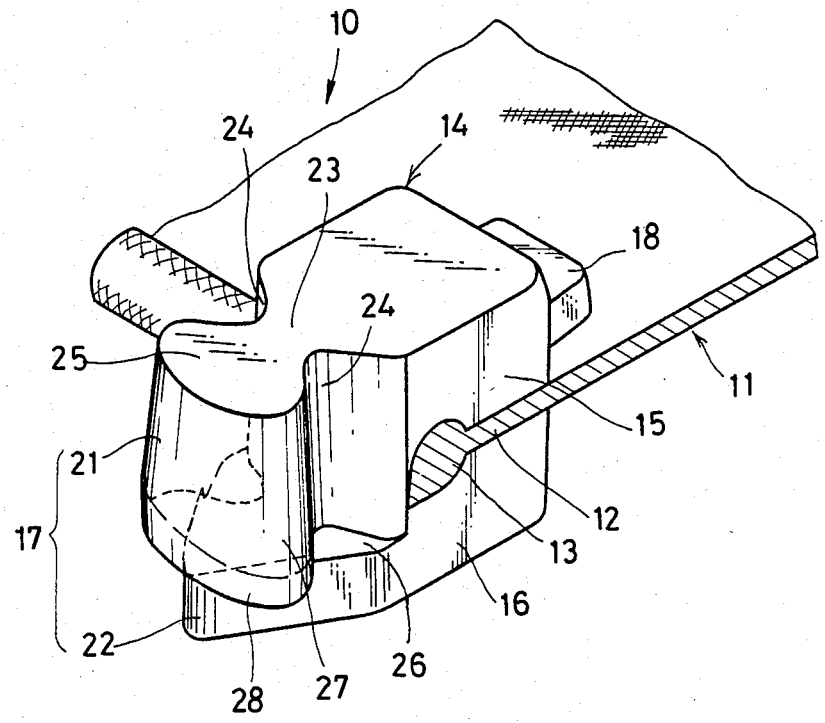
FIG. 4 is a fragmentary perspective view of a slide fastener stringer according to the present invention.

The principles of the present invention are particularly useful when embodied in a slide fastener stringer such as shown in FIG. 4, generally indicated by the nmumeral 10.

The slide fastener striner 10 comprises an elongate stringer tape 11 including a longitudinal edge portion 12 having a marginal beaded edge 13. The longitudinal edge portion 12 supports thereon a series of uniformly spaced coupling elements 14 (only one shown for clarity) made of synthetic resin injection-molded on the longitudinal edge portion 12 including the beaded edge 13. Each of the coupling elements 14 comprises a generally rectangular body having a pair of upper and lower legs 15, 16 disposed one on each side of the longitudinal edge portion 12, and a coupling projection 17 extending from the legs 15, 16 away from the tape 11 beyond the beaded edge 13. The body of the coupling element 14 also includes a rear tongue 18 of reduced width and thickness disposed on the longitudinal edge portion 12 and extending from each of the legs 15, 16 away from the coupling projection 17, and a connecting portion 19 (FIG. 5) extending through an aperture 20 in the longitudinal edge portion 12 to interconnect the legs 15, 16. The rear tongues 18 serve to guide thereon a slider (not shown) when the latter is moved to slide along the coupling elements 14.

Figure 5:
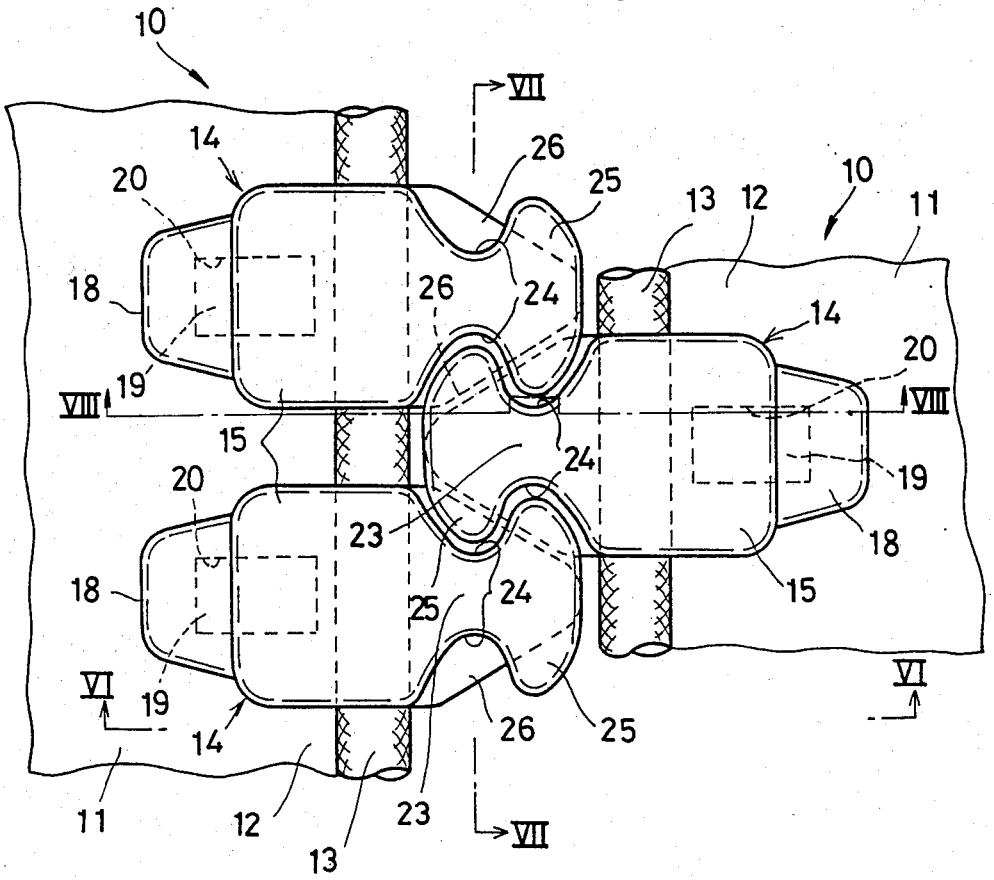
FIG. 5 is a fragmentary plan view of the stringer of FIG. 4 as it is coupled with a co-operating like stringer.
Figure 6:
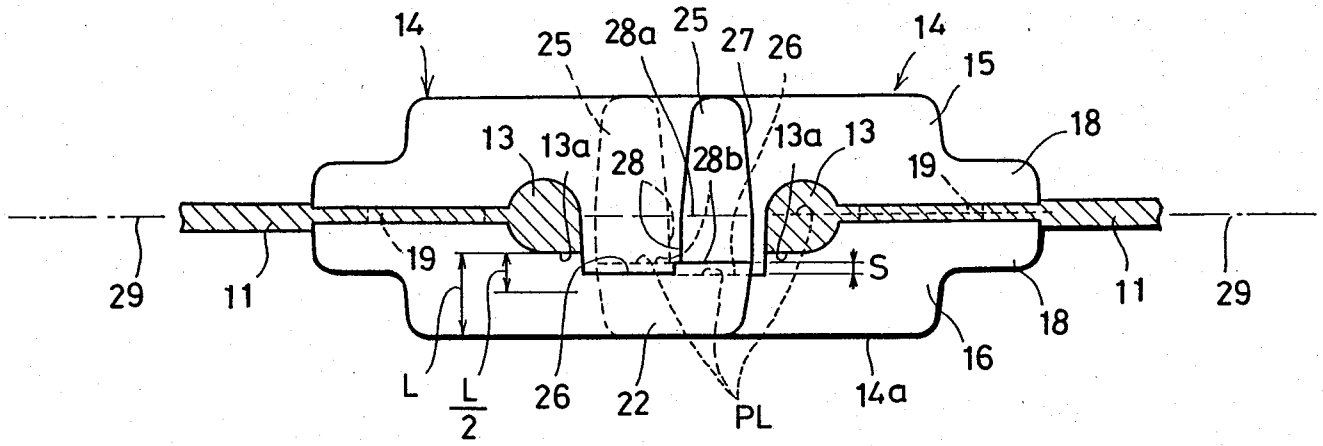
FIG. 6 is a cross-sectional view taken along line VI—VI of FIG. 5.
Figure 7:
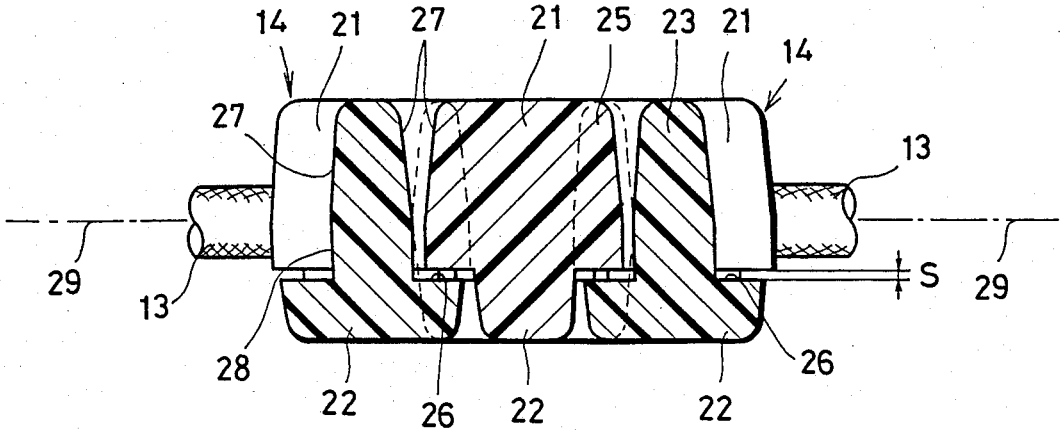
FIG. 7 is a cross-sectional view taken along line VII—VII of FIG. 5.
Figure 8:
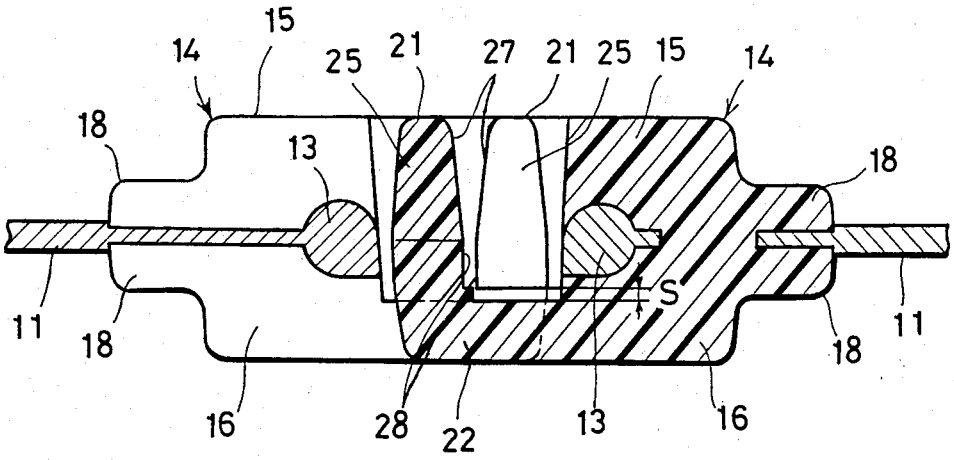
FIG. 8 is a cross-sectional view taken along line VIII—VIII of FIG. 5.

The coupling projection 17 includes a pair of integral superposed upper and lower coupling portions 21, 22 respectively engageable with lower and upper coupling portions 22, 21 of a pair of adjacent coupling elements 14, 14 on a co-operating like stringer 10, as shown in FIG. 5. The upper coupling portion 21 extends vertically downwardly from one side of the tape 11 toward the other side beyond the thickness of the longitudinal edge portion 13. The upper coupling portion 21 has a narrowed neck portion 23 defined by a pair of recesses 24, 24 on opposite sides of the coupling element 14, and a rounded head portion 25 contiguous to and complementary in shape with the neck portion 23. The lower coupling portion 22 has a substantially triangular shape in horizontal cross section tapering away from the legs 15, 16 and terminating at an end of the head portion 25 remote from the neck portion 24. Thus the lower triangular coupling portion 21 has a pair of support wings 26, 26 extending outwardly from the neck portion 24 in opposite directions. The wings 26 support thereon the head portions 25 of adjacent coupling elements 14 received in the recesses 24 when the opposed stringers 10, 10 are closed as shown in FIG. 5. As shown in FIG. 6, each of the support wings 26, 26 is slightly recessed to define jointly with the lower surface of the head portion 25 of the mating coupling element 14, a space or clearance S which serves to allow the opposed coupling elements 14, 14 to be smoothly brought into and out of interdigitating engagement with each other.

The head portion 25 of the coupling projection 17 has an arcuate side surface which includes an upper portion 27 bevelled at a suitable small angle such as 8 degrees to a normal to the tape 11 to allow the coupling elements 14 to be easily removed from the mold cavities (not shown) during manufacture, and a flat lower portion 28, called abutment surface hereafter, extending perpendicularly to the tape 11.

Figure 1:
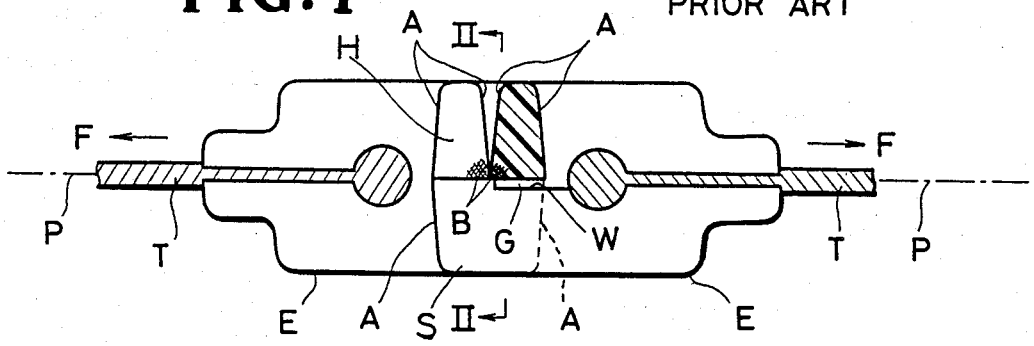
FIG. 1 PRIOR ART
FIG. 1 is a transverse cross-sectional view of a prior slide fastener having a pair of coupled slide fastener stringers.
Figure 2:
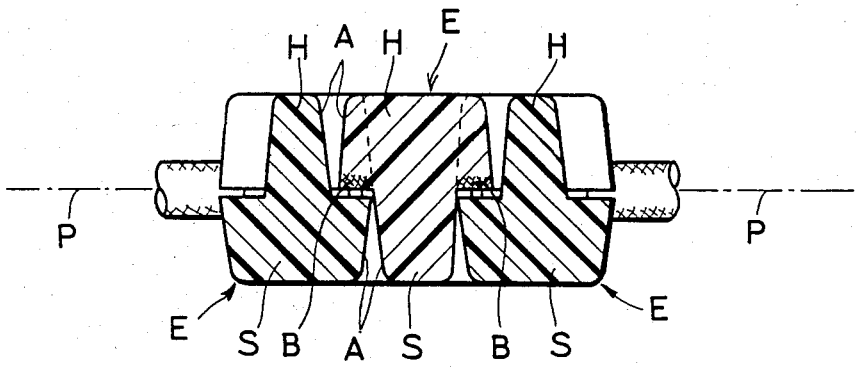
FIG. 2 PRIOR ART
FIG. 2 is a fragmentary longitudinal cross-sectional view taken along line II—II of FIG. 1.
Figure 3:
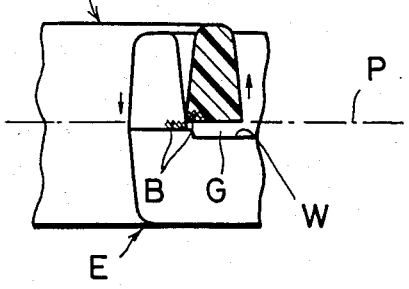
FIG. 3 PRIOR ART
FIG. 3 is a fragmentary view of FIG. 1, showing a disadvantage of the prior slide fastener.

As shown in FIG. 6, the abutment surface 28 has an upper edge **28*a* extending in a central plane 29 transverse to the stringer tape 11, and a lower edge 28*b* extending in a plane below the beaded edge 13 of the longitudinal edge portion 12. The plane in which the lower edge 28*b* extends is downwardly offset with respect to a lower surface 13*a* of the beaded edge 13 by a distance substantially equal to or less than half, and preferably one-third of the distance L between the lower surface 13*a* and a lower surface 14*a* of the coupling element 14. If the offset distance is larger than the half of the distance L, the lower coupling portion 22 would fail to provide a mechanical strength enough to withstand a severe thrust applied perpendicularly to the tape 11 during use. If the lower edge 28*b* lies above the lower surface 12*a* of the beaded edge 12, then the results would be no different than that of the prior slide fastener stringer shown in FIGS. 1 to 3**.

The coupling element 14 is produced by means of a mold (not shown) having a pair of co-operating mold halves constructed such that a mold parting line PL extends along the lower edge **28*b* of the head's side surface 28, the upper surface of thhe support wing 26, and the central plane 29 of the stringer tape 11, as shown in FIG. 6**.

The two stringers 10, 10 are coupled together as shown in FIGS. 5 through 8 under a no-load condition in which the head portions 25 are received in the recesses 24, 24 of the opposing coupling elements 14. Upward and downward movement of either coupling element 14 is substantially limited by the support wings 26 extending beneath the head portions 25, despite the clearances S provided above the wings 26. The support wings 26 prevent the coupled stringers 10, 10 from disengaging by relative movement of the coupling elements 14 perpendicular to the general plane of the stringer tape 11.

Figure 9:
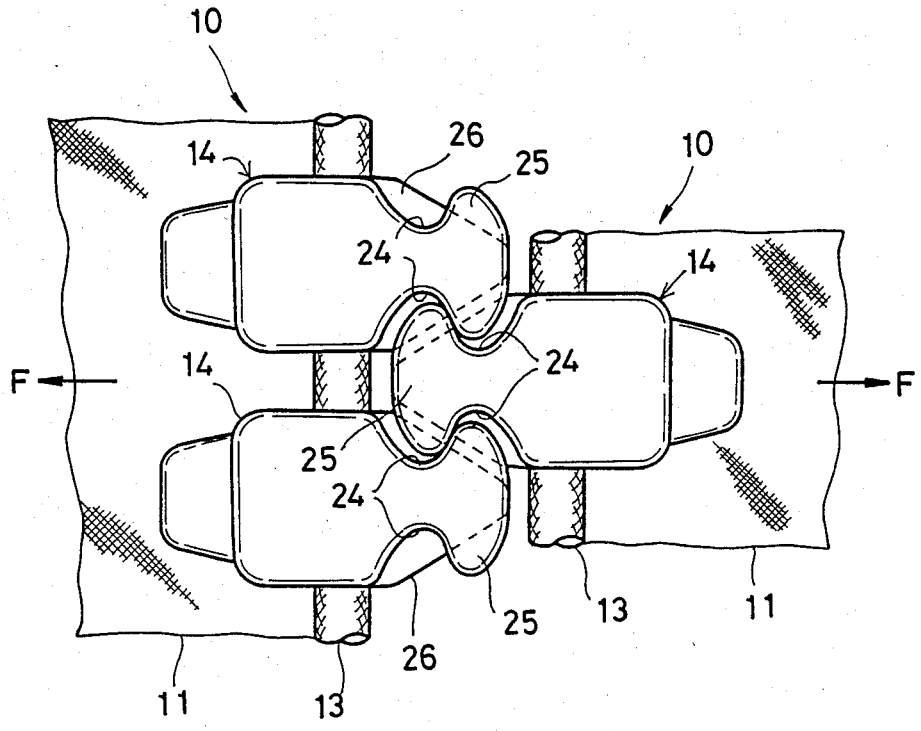
FIG. 9 is a view similar to FIG. 5, showing the stringers as they are subjected to lateral pulling forces.

When lateral pulling forces F are applied to the coupled stringers 10, 10, the opposing coupling elements 14, 14 are brought into abutting engagement with each other at the rear of the respective head portions 25 as shown in FIG. 9. The lateral pulling forces F on the tapes 11, 11 are off center with respect to the lower edges **28*b* of the respective abutment surfaces 28 and generate rotational forces on the coupling elements 14, and in the absence of the flat abutment surfaces 28, would tend to bring about a flex condition of the stringers 10, 10. However the extension of the flat abutment surfaces 28 from the central plane 29 of the tape 11 beyond the lower surfaces 13*a* of the beaded edges 13, resists the flexed configuration of the stringers 10, 10, inasmuch as the lateral pulling forces F tend to bring the abutment surfaces 28, 28 of adjacent coupling elements 14, 14 flush together. Another advantages provided by the abutment surfaces 28 is that relatively large contact areas between coupling elements 14 are obtained. It has been experimentally found that slide fasteners embodying the stringers 10, 10 had a coupling strength, resistant to both the lateral pulling forces and the vertical thrust, almost 40 to 50 percent over the coupling strength of the slide fasteners shown in FIG. 1. Substantially the same results had been obtained even when the abutment surface 28 was bevelled at the same angle to the bevelled upper surface 27 of the head portion 25**.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A slide fastener stringer comprising:

(a) a stringer tape having a longitudinal edge portion;

(b) a series of uniformly spaced coupling elements mounted on and along said longitudinal edge portion, each said coupling element including a pair of legs disposed astride said longitudinal edge portion, and a coupling projection extending from said legs away from said tape beyond said longitudinal edge portion; and (c) said coupling projection having a pair of integral superposed first and second coupling portions having different shapes and respectively engageable with second and first coupling portions of a pair of adjacent coupling elements on a co-operating like stringer, said first portion extending from one side of said stringer tape toward the other side beyond the thickness of said longitudinal edge portion.

2. A slide fastener stringer according to claim 1, said longitudinal edge portion including a marginal beaded edge, said first portion terminating in a plane extending parallel to the general plane of said tape beyond a surface of said beaded edge adjacent to said second coupling portion.

3. A slide fastener stringer according to claim 2, said plane of termination of said first coupling portion being offset with respect to said surface by a distance less than half the distance between said surface and an outer surface of said coupling projection disposed on said second coupling portion and lying parallel to the general plane of said stringer tape.

4. A slide fastener stringer according to claim 3, said offset distance being one-third of the distance between said surface and said outer surface.

5. A slide fastener stringer according to claim 2, said first coupling portion having a flat abutment surface extending from said second coupling portion perpendicularly to said stringer tape beyond said surface of said beaded edge, and a bevelled surface contiguous to said abutment surface and extending at a small angle to a normal to said stringer tape.

6. A slide fastener stringer according to claim 5, said abutment surface having one edge extending in a central plane transverse to said stringer tape and the other edge extending parallel to said one edge at a distance less than half the distance between said surface and an outer surface of said coupling projection disposal on said second coupling portion and lying parallel to the general plane of said stringer tape.

7. A slide fastener stringer according to claim 6, said first coupling portion having a narrowed neck portion extending from said legs, and a rounded head portion contiguous to and complementary in contour with said neck portion, said second coupling portion having a substantially triangular shape tapering from said legs and terminating in an end of said head portion remote from said neck portion, said triangular second coupling portion including a pair of support wings extending outwardly from said neck portion in opposite directions, said abutment surface extending only around said head portion.

* * * * *